US007062817B2

(12) United States Patent
Lee

(10) Patent No.: US 7,062,817 B2
(45) Date of Patent: Jun. 20, 2006

(54) HINGE ASSEMBLY STRUCTURE FOR OPENING AND CLOSING OF DOOR OF STORAGE FACILITY

(75) Inventor: Young Gil Lee, Asan (KR)

(73) Assignee: Winia Mando, Inc., Asan (KR)

( * ) Notice: Subject to any disclaimer, the term of this patent is extended or adjusted under 35 U.S.C. 154(b) by 26 days.

(21) Appl. No.: 10/796,081

(22) Filed: Mar. 10, 2004

(65) Prior Publication Data

US 2005/0108853 A1 May 26, 2005

(30) Foreign Application Priority Data

Mar. 14, 2003 (KR) ..... 10-2003-0016149

(51) Int. Cl.
*E05D 11/10* (2006.01)

(52) U.S. Cl. ..... 16/334; 16/330; 16/303; 220/830; 220/844

(58) Field of Classification Search ..... 16/334, 16/330, 303, 284, 306; 312/319.1, 319.2, 312/323; 62/440; 220/259, 315, 326, 826, 220/830–832, 843–844, 259.1, 259.2, 259.3, 220/263, 264

See application file for complete search history.

(56) References Cited

U.S. PATENT DOCUMENTS

| | | | | |
|---|---|---|---|---|
| 3,930,594 | A * | 1/1976 | Jungmann | 220/830 |
| 4,822,965 | A * | 4/1989 | Hyogo et al. | 200/333 |
| 5,317,785 | A * | 6/1994 | Kobayashi | 16/329 |
| 6,141,831 | A * | 11/2000 | Novin et al. | 16/330 |
| 6,178,597 | B1 * | 1/2001 | Suzuki et al. | 16/330 |
| 6,286,187 | B1 * | 9/2001 | Chang | 16/340 |
| 6,568,032 | B1 * | 5/2003 | Ramsauer | 16/329 |
| 6,665,906 | B1 * | 12/2003 | Li | 16/330 |
| 2003/0019873 | A1 * | 1/2003 | Nam et al. | 220/524 |
| 2004/0211211 | A1 * | 10/2004 | Nam et al. | 62/440 |
| 2004/0256390 | A1 * | 12/2004 | Nam et al | 220/264 |

FOREIGN PATENT DOCUMENTS

| | | | |
|---|---|---|---|
| JP | 06010556 | A * | 1/1994 |
| JP | 2000192939 | A * | 7/2000 |
| JP | 2005009299 | A * | 1/2002 |
| KR | 2003030759 | A * | 4/2003 |

* cited by examiner

*Primary Examiner*—Chuck Y. Mah
(74) *Attorney, Agent, or Firm*—Fitzpatrick, Cella, Harper & Scinto

(57) ABSTRACT

A hinge assembly structure for opening and closing a door in a storage facility is provided. The hinge assembly structure includes a main body provided with a storage room, a door opening and closing the storage room on the upper portion of the main body, a hinge assembly connecting the door rotatably with the main body, and a hinge receptacle accommodating the hinge assembly, in which the hinge receptacle is integrally formed between the door and the main body. Here, the hinge assembly includes a plurality of rotating members which convert a rotational movement into a rectilinear movement according to opening and closing of the door, a fixing member which accommodates, supports and fixes the rotating members and operates in engagement with the rotating members, elastic members which give an elastic restoring force and an elastic repulsive force to the rotating members and restricting a rotational movement, and a fixed shaft which fixedly couples the rotating members, the fixing member, and the elastic members, in which the hinge assembly is inserted into and installed in the hinge receptacle via one side thereof. The hinge assembly structure is very simple and easy to be assembled with a main body, and also mitigates a closing speed of a door to prevent a mechanical impact during closing the door, and seeks stable opening and closing of doors via a secure assembly.

11 Claims, 16 Drawing Sheets

HINGE ASSEMBLY STRUCTURE FOR OPENING AND CLOSING OF DOOR OF STORAGE FACILITY

BACKGROUND OF THE INVENTION

1. Field of the Invention

The present invention relates to a hinge assembly structure for opening and closing of a door in a storage facility keeping in store foods such as Kimchi which is the Korean traditional preserved vegetables, and more particularly, to a hinge assembly structure which rotates forward and backward to then perform a reciprocal rectilinear movement via an elastic restoring force and an elastic repulsive force of elastic members, and to thereby mitigate an opening and closing speed of a door to prevent a mechanical impact to be applied to a main body of the Kimchi storage facility during opening and closing of the door, and seek stable opening and closing of the door via a secure assembly.

2. Description of the Related Art

In the case of general refrigerators which are used in homes and so on, internal temperatures in the refrigerators may severely vary during opening and closing doors. Accordingly, a period of time for preserving foods such as Kimchi should be short. Also, since an appropriate temperature of maintaining the proper ripening temperature of Kimchi is lower than those of general cold storage foods, it is difficult to keep Kimchi in general refrigerators for a long time. Accordingly, Kimchi is stored in a particular Kimchi storage facility called a Kimchi refrigerator.

A preserved vegetables storage facility which is so-called a Kimchi refrigerator includes a storage chamber storing Kimchi in the inner upper side of a main body, which is isolated from the external air through an isolation member, a mechanical chamber in the inner lower side thereof, having a compressor and a condenser in order to cool the storage chamber, and a door which is fixed with a hinge in the upper portion of the main body, in order to seal the storage chamber, and which is opened and closed up and down.

FIG. 1 is a perspective view of an embodiment of a conventional storage facility in which preserved vegetables such as one Korean traditional food called "Kimchi" are kept in store. FIG. 2 is an exploded perspective view showing a hinge coupling structure of the Kimchi storage facility shown in FIG. 1.

As shown in FIG. 1, the Kimchi storage facility includes a main body 1 forming an external case, two storage chambers 3 formed in the main body 1, a mechanical chamber having a cooling device under the storage chambers 3, and two doors 2 covering the storage chambers 3 in the upper portion of the main body 1.

Each door 2 is hinged on the upper portion of the rear surface of the Kimchi storage facility, so that it is opened upward and closed by its own gravitational weight.

As described above, the conventional door 2 is opened and closed by operation of the hinge. An example of a conventional hinge coupling structure is shown in FIG. 2 more specifically.

That is, as shown in FIG. 2, a main body hinge portion 20 which rotatably supports the door 2 is provided in the upper portion of the rear surface of the main body 1, and a door hinge portion 30 which is rotatably combined with the main body hinge portion 20 is provided in the rear portion of the door 2.

The main body hinge portion 20 includes a hinge bracket 21 of a predetermined length which is fixed to a top cover 15 and a hinge cover 25 which isolates the rear portion of the hinge bracket 21, in which the upper portion of the hinge bracket 21 is protruded toward the upper portion of the top cover 15.

A shaft coupling hole 28 for coupling a hinge shaft 40 is formed penetratively on both sides of the hinge bracket 21 in a hinge axial direction, and the hinge cover 25 is combined in the main body hinge portion 20 in order to isolate the rear portion of the hinge bracket 21.

The door hinge portion 30 includes a hinge receptacle 33 which is formed in the rear portion of the door 2 as a predetermined accommodation space for partially accommodating the upper portion of the main body hinge portion 20, and a shaft coupling portion 31 which is provided with a predetermined space in both sides of the hinge receptacle 33 in order to couple a hinge shaft 40.

The hinge receptacle 33 is separated from the shaft coupling portion 31 by both the side walls of the hinge receptacle 33. On either side wall of the hinge receptacle 33 is formed a rotational shaft hole 38 which communicates with the shaft coupling portion 31 in correspondence to the shaft coupling hole 28 of the hinge bracket 21. The hinge shaft 40 is made to pass through the rotational shaft holes 38, and is coupled with the shaft coupling hole 28, to then be fixed by a stop ring 32 to prevent a shaft axial direction from seceding.

However, since the hinge receptacle 33 accommodating the main body hinge portion 20 is formed in the rear portion of the door 2 with a predetermined accommodating space in such a conventional Kimchi storage facility having the above-described hinge coupling structure, the rear portion of the upper wall of the hinge receptacle 33 contacts the rear surface of the main body hinge portion 20, that is, the external surface of the hinge cover 25. In this case, the weight of the door 2 is transferred to the contact portion. Thus, if the door 2 is opened with an excessive force, the rear portion of the door 2 may be broken.

Also, since there is no operational function or separate mechanism which holds the door 2 so as to stop at a predetermined position during opening the door 2 in the hinge coupling structure having the conventional structure, the door 2 may have only to be in a completely closed position, or in a completely opened position where the door 2 is opened by 90° or so backwards.

Accordingly, if the door 2 is not held by the hand during opening and closing it, the door 2 is closed abruptly by the weight of the door 2, which may apply a mechanical impact on the whole Kimchi storage facility or cause a safety accident in the case that the finger or fingers of a user is put under the abruptly closing door 2 carelessly during opening and closing the door 2.

SUMMARY OF THE INVENTION

The present invention provides a new hinge assembly structure differing from the conventional one which causes the rear portion of a conventional Kimchi refrigerator to be broken when a door of the Kimchi refrigerator is opened, and also causes a main body of the Kimchi refrigerator to receive a mechanical impact in the case that the door is abruptly closed by the gravitational weight of the door.

To solve the above problems, it is an object of the present invention to provide a hinge assembly structure which rotates forward and backward to then enable a reciprocal rectilinear movement via an elastic restoring force and an elastic repulsive force of elastic members, and to thereby play a role of a buffering function during opening and closing the door.

It is another aspect of the present invention to provide a hinge assembly structure for opening and closing a door in a storage facility keeping foods such as Kimchi which is the Korean preserved vegetables in store, in which a door opening and closing mechanism is very simple and easy to be assembled with a main body, to thereby mitigate a closing speed of a door to prevent a mechanical impact during closing the door, and seeks stable opening and closing of the door via a secure assembly.

To accomplish the above object of the present invention, there is provided a hinge assembly structure comprising: a main body provided with a storage room; a door opening and closing the storage room on the upper portion of the main body; a hinge assembly connecting the door rotatably with the main body; and a hinge receptacle accommodating the hinge assembly, wherein the hinge receptacle comprises: an upper hinge receptacle which is integrally formed on the rear surface of the door; and a lower hinge receptacle which is integrally formed on the upper surface of the main body and engaged opposingly with the upper hinge receptacle, and wherein the hinge assembly comprises: a fixing member which is provided with passive rotators on the inner circumferential surfaces of both ends and a throughhole penetrating the passive rotators at the center thereof, and which fixedly rotates during rotation according to opening and closing of the door; a plurality of rotating members each which is provided with a rotator engaged opposingly with the passive rotator of the fixing member in one end, and a throughhole penetrating the central portion of the rotating member, and which convert a rotational movement into a rectilinear movement during rotating according to opening and closing of the door; a plurality of elastic members each which is installed in opposition to the rotator of the rotating member accommodated in the passive rotator, and repeats elastic compression and restoration according to the left and right rectilinear movement of the rotating members; and a fixed shaft which is penetrated and inserted into the throughhole of the rotating members and fixing member, and then taking hold of both ends of the plurality of elastic members to thereby restrict and fix the movement, in which the hinge assembly is inserted into and installed in the hinge receptacle via one side thereof.

Here, it is preferable that the hinge receptacle according to the present invention comprises: a lower hinge receptacle which is integrally formed in one of the rear surface of the door and the upper surface of the main body, and is provided with a coupling guider which accommodates the fixing member of the hinge assembly and is correspondingly combined with a coupler in the fixing member on the inner circumferential surface of the lower hinge receptacle; an upper hinge receptacle which is integrally formed in opposition to the lower hinge receptacle, in one of the rear surface of the door and the upper surface of the main body where the lower hinge receptacle is not formed, and is provided with coupling guiders which accommodate the respective rotating members of the hinge assembly and is correspondingly combined with a coupler in the respective rotating members on the inner circumferential surface of the upper hinge receptacle; and an auxiliary supporter which is formed in the side surface of the upper hinge receptacle and supports the left and right movement of the door during assembling the door.

Also, in the present invention, a passive rotator is formed in either end of the fixing member, and a plurality of rotating members provided with the rotator can be inserted into the passive rotator symmetrically with each other.

Also, it is preferable that the passive rotator in the fixing member and the rotator in the rotating member have a spirally sloped surface and a horizontally truncated surface, respectively so that they are engaged in opposition to each other.

In particular, the spirally sloped surface is formed to have a structure of compressing the elastic members in which the rotating members are taken out from the fixing member during rotating counterclockwise, and of receiving an elastic restoring force from the elastic members in which the rotating members are inserted into the fixing member during rotating clockwise.

BRIEF DESCRIPTION OF THE DRAWINGS

The above and other objects and advantages of the present invention will become more apparent by describing the preferred embodiments thereof in more detail with reference to the accompanying drawings in which.

DETAILED DESCRIPTION OF THE INVENTION

Preferred embodiments of the present invention will be described with reference to the accompanying drawings.

Figure 1:
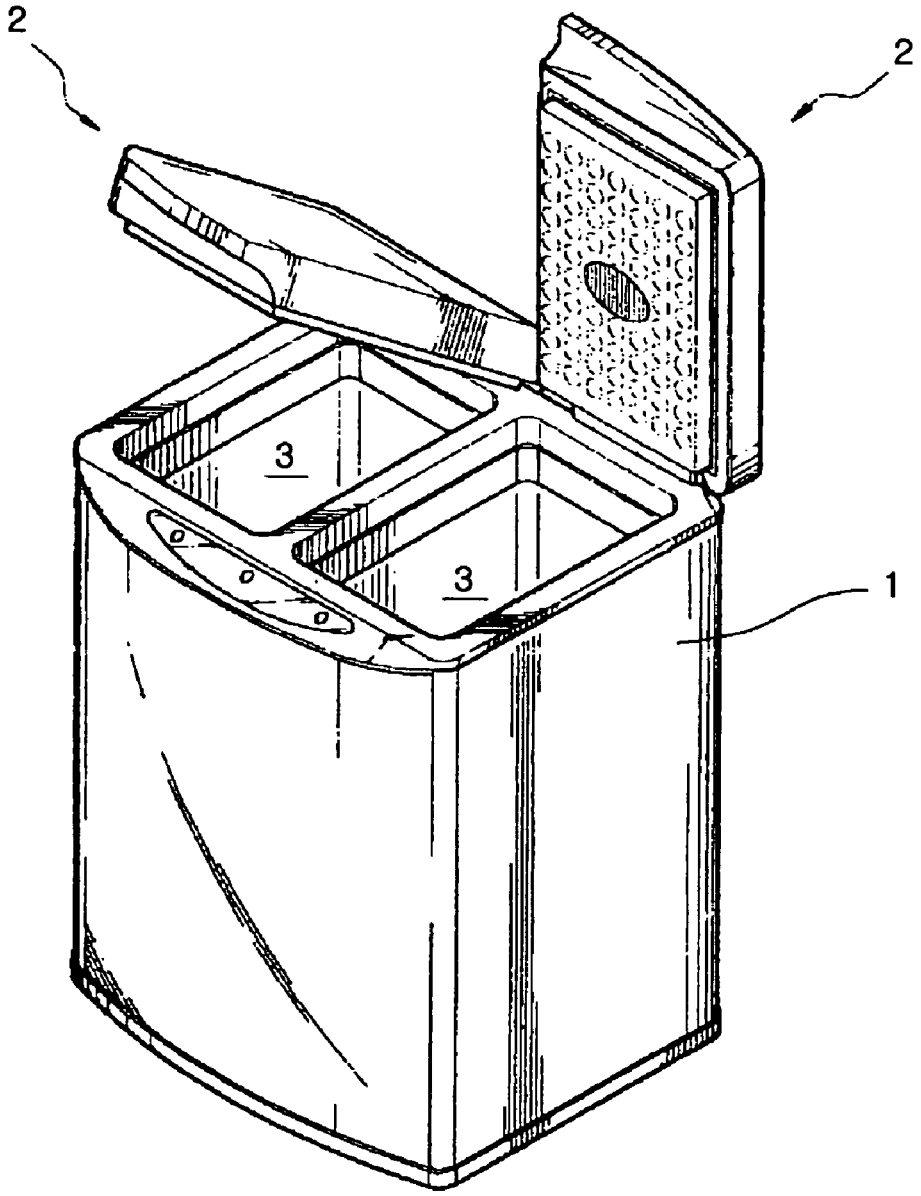
FIG. 1 (PRIOR ART)
FIG. 1 is a perspective view of an embodiment of a conventional storage facility in which preserved vegetables such as one Korean traditional food called "Kimchi" are kept in store.
Figure 2:
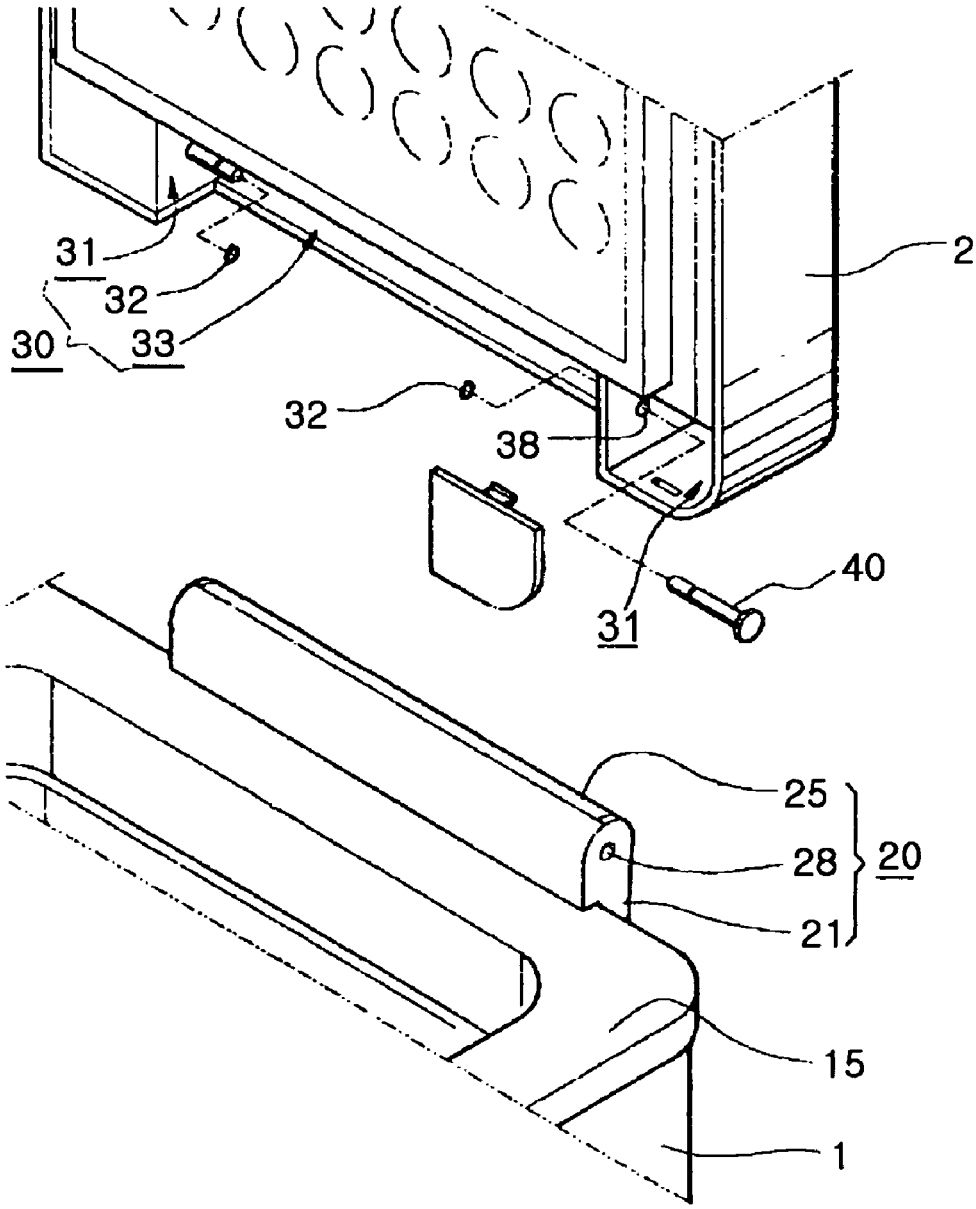
FIG. 2 (PRIOR ART)
FIG. 2 is an exploded perspective view showing a hinge coupling structure of the Kimchi storage facility shown in FIG. 1.
Figure 3:
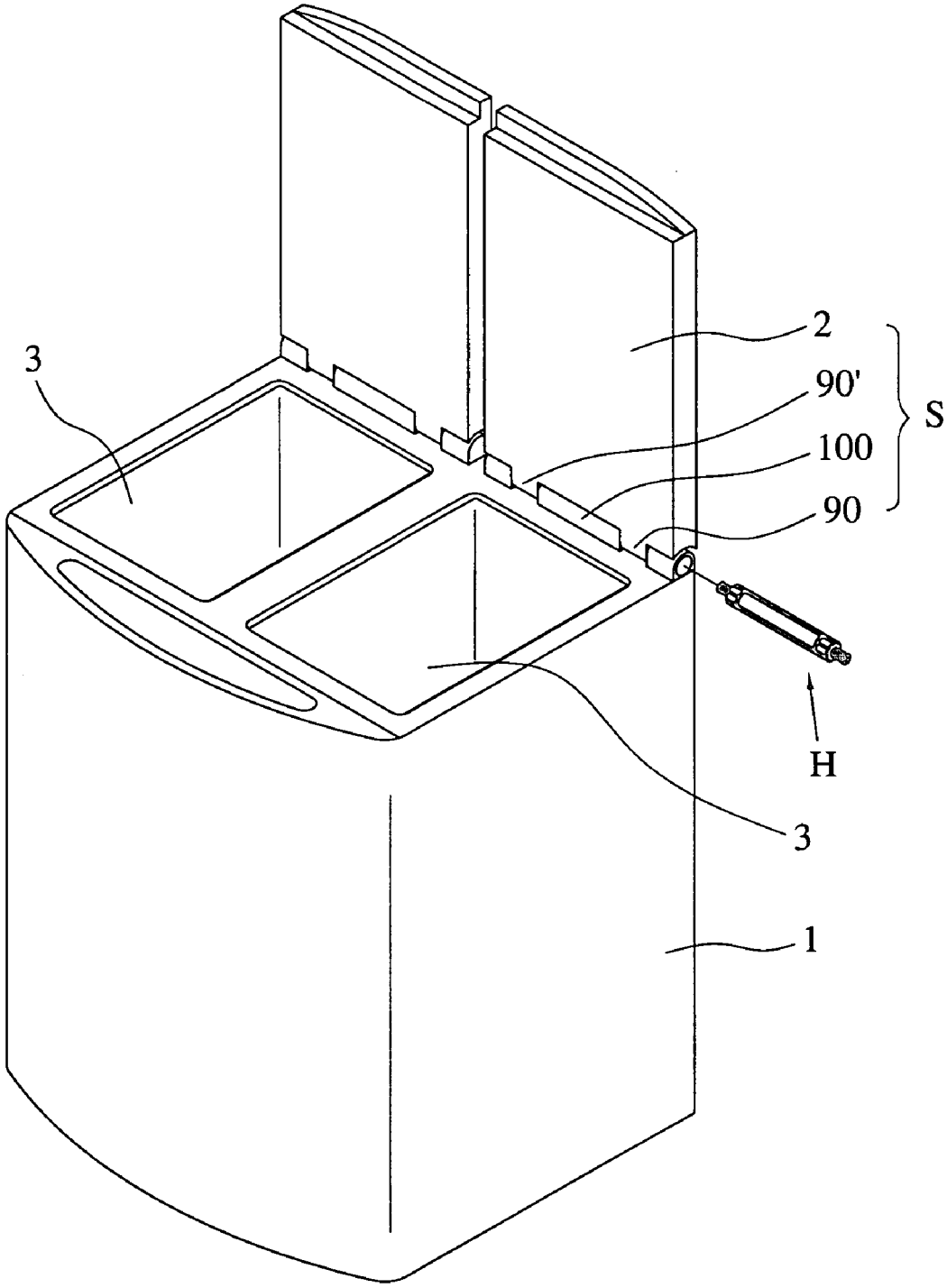
FIGS. 3 and 4 are perspective views of a door opened state and a door closed state respectively showing a hinge assembly is installed between each door and a main body in a Kimchi storage facility, according to a preferred embodiment of the present invention.
Figure 4:
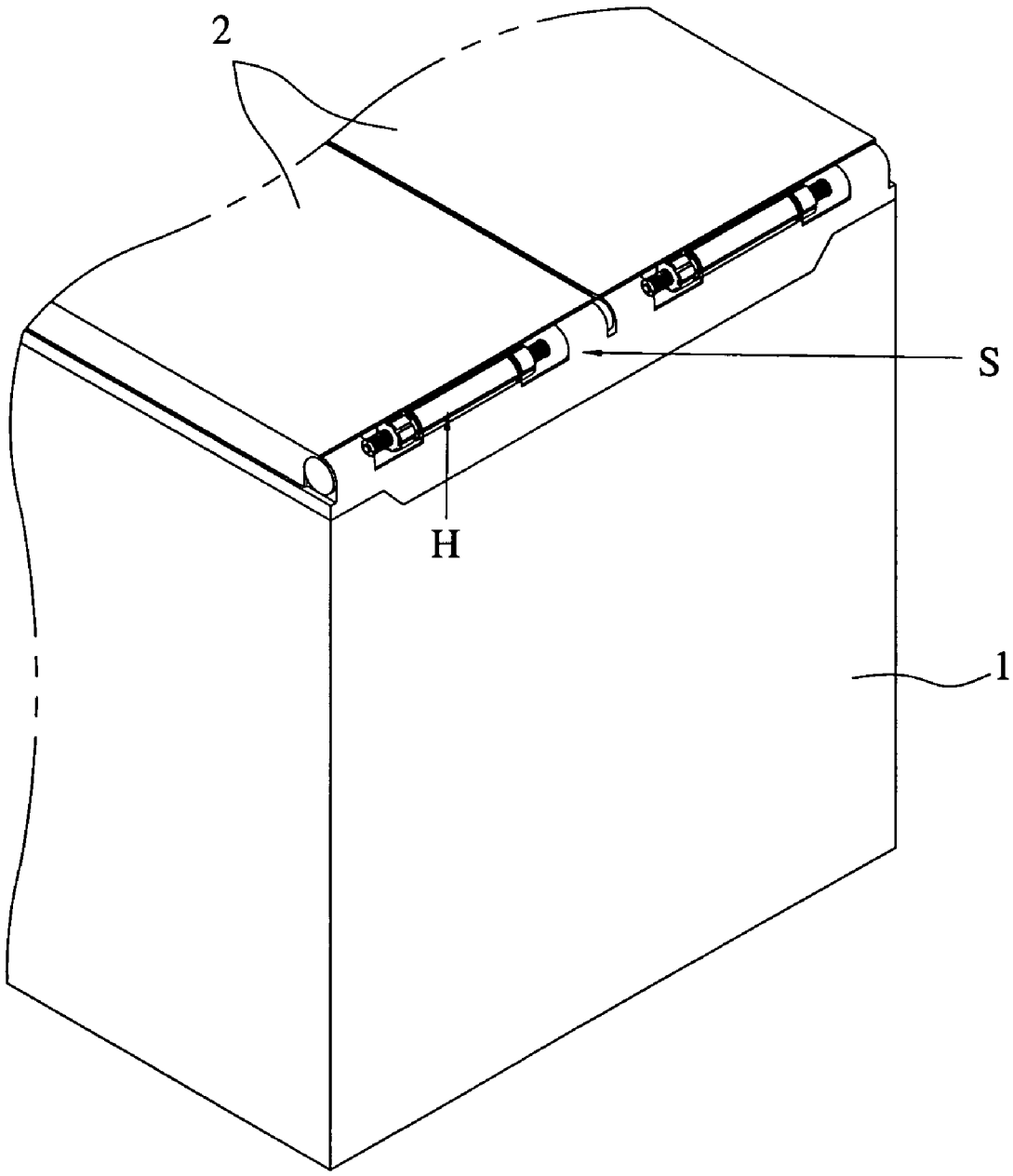

FIGS. 3 and 4 are perspective views of a door opened state and a door closed state respectively showing a hinge assembly is installed between each door and a main body in a Kimchi storage facility, according to a preferred embodiment of the present invention.

As shown in FIGS. 3 and 4, a Kimchi storage facility according to the present invention includes a main body 1 provided with two storage rooms 3 which can keep Kimchi in store, two doors 2 which open and close the respective storage rooms 3 upwards from the upper portion of the main body 1, a hinge assembly H rotatably connecting each door 2, and a hinge receptacle S which is integrally formed between the rear surface of the door 2 and the upper surface of the main body 1 so as to accommodate the hinge assembly H.

Here, the hinge receptacle S includes an lower hinge receptacle 100 which is integrally formed on the rear upper surface of the main body 1, and a upper hinge receptacle 90 and 90' which is integrally formed on the rear surface of the door 2, in which the upper hinge receptacle 90 and 90' and the lower hinge receptacle 100 are engaged with each other to have an accommodation space.

In particular, at the state where the upper hinge receptacle 90 and 90' and the lower hinge receptacle 100 in the hinge receptacle S have been engaged with each other to have an accommodation space, the hinge assembly H is simply fitted and inserted via one side of the hinge receptacle S (generally one side of the upper hinge receptacle 90) to be installed in the hinge receptacle S.

Figure 5:
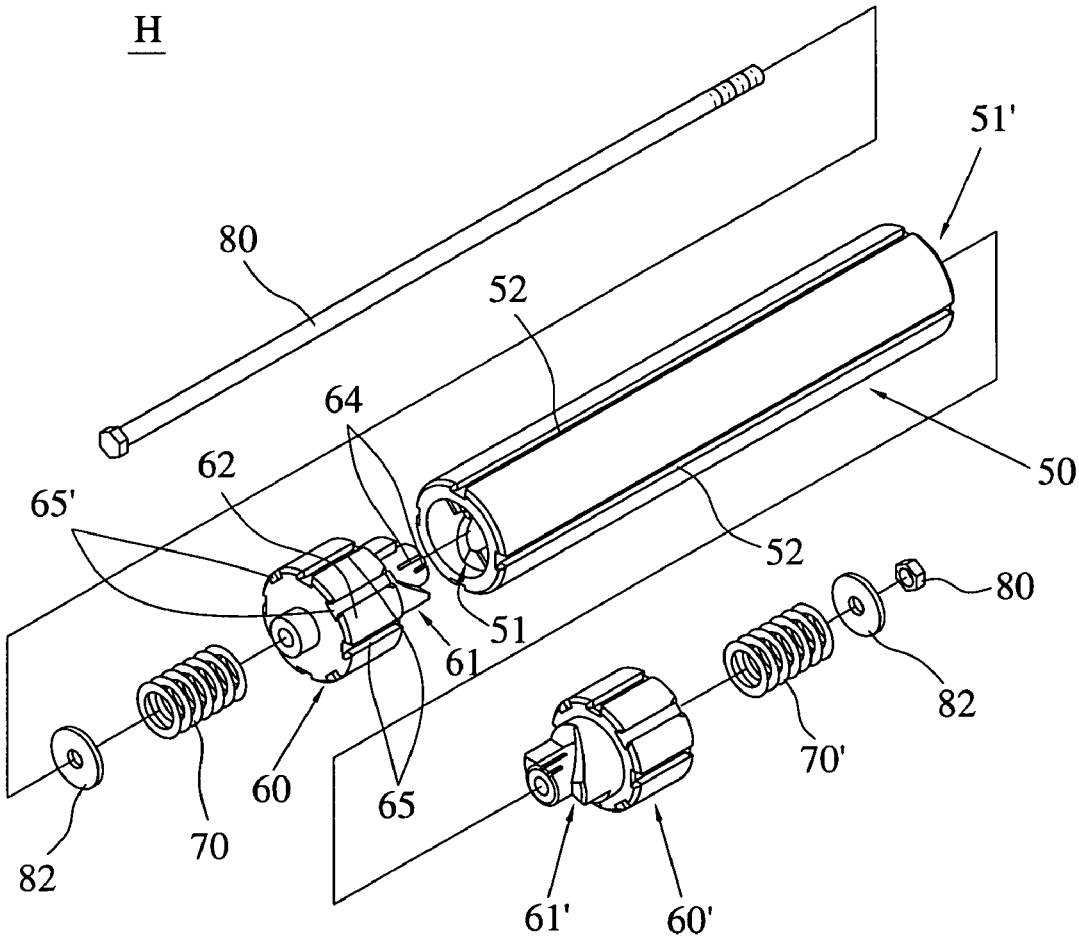
FIG. 5 is a perspective view showing a hinge assembly according to a first embodiment of the present invention.
Figure 6:
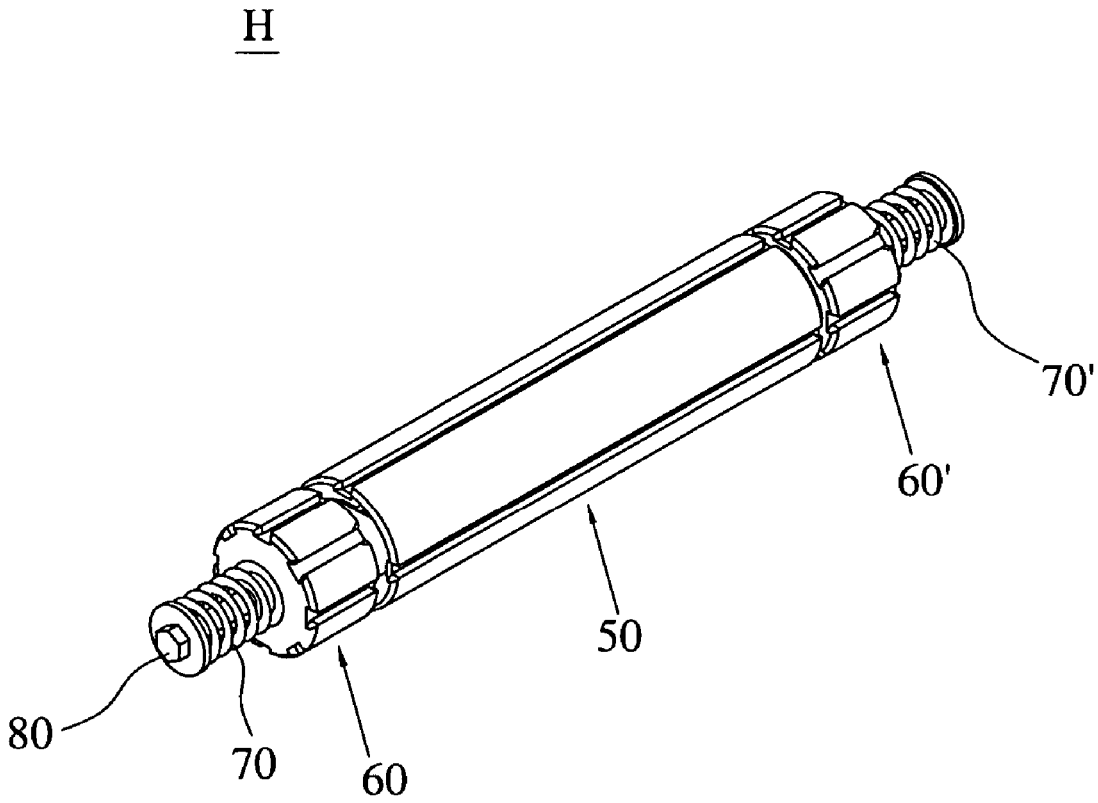
FIG. 6 is an assembled perspective view showing the hinge assembly of FIG. 5 according to the first embodiment of the present invention.
Figure 7:
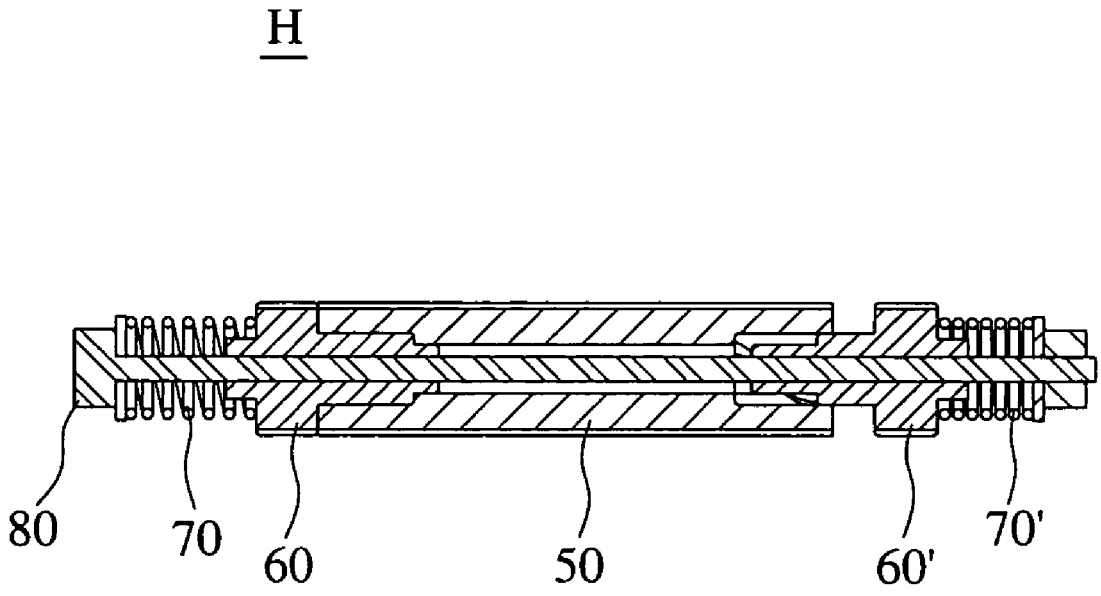
FIG. 7 is a cross-sectional view showing the hinge assembly of FIG. 6 according to the first embodiment of the present invention.

FIG. 5 is a perspective view showing a hinge assembly according to a first embodiment of the present invention. FIG. 6 is an assembled perspective view showing the hinge assembly of FIG. 5 according to the first embodiment of the present invention. FIG. 7 is a cross-sectional view showing the hinge assembly of FIG. 6 according to the first embodiment of the present invention.

As shown in FIGS. 5 through 7, the hinge assembly H according to the first embodiment of the present invention includes: a plurality of rotating members 60 and 60' which are provided with rotators 61 and 61' in the outer circumferential surface of one end, respectively, couplers 65 and 65' formed in the whole axial direction on the outer circumferential surface of main bodies 62 and 62' having the larger diameters than those of the rotators 61 and 61', and a throughhole 63 centrally in the axial direction; a cylindrical fixing member 50 which is provided with rotators 61 and 61' in the rotating members 60 and 60' on at least one end thereof, respectively, passive rotators 51 and 51' engaged with the rotators 61 and 61' in opposition to each other, a throughhole 53 penetrating the passive rotators 51 and 51' and formed centrally in the axial direction, and couplers 52 formed in the whole axial direction on the outer circumferential surface; a plurality of elastic members 70 and 70' which are fitted and inserted into the other sides of the rotators 61 and 61' in the rotating members 60 and 60', so as to give an elastic restoring force and an elastic repulsive force to the rotating members 60 and 60' accommodated in the fixing member 50; and a fixed shaft 80 which penetrates and inserted into the throughholes 53 and 63 in the fixing member 50 and the rotating members 60 and 60', to thereby support a mutual coupling between the rotating members 60 and 60' and the fixing member 50 and play a role of restricting movement of the elastic members 70 and 70'.

That is, the hinge assembly H according to the first embodiment of the present invention has a structure that the passive rotators 51 and 51' are provided in both ends of the fixing member 50, and the rotating members 60 and 60' provided with the rotators 61 and 61' and the elastic members 70 and 70' are inserted symmetrically in the left and right sides of the passive rotators 51 and 51'.

Here, the plurality of elastic members 70 and 70' have the same modulus of elasticity and gives the same amount of an elastic force in the left and right sides of the fixing member 50.

As described above, the hinge assembly H has a structure that the plurality of rotating members 60 and 60' and the elastic members 70 and 70' are installed in both ends of the fixing member 50. Accordingly, when the hinge assembly H is applied to the door 2, the plurality of rotating members 60 and 60' and the elastic members 70 and 70' operate to mitigate the own weight of the door 2 in both directions, and thus the hinge assembly H is very stable in a structural view.

Hereinbelow, the structural elements of the hinge assembly H according to the present invention will be described in more detail.

When the hinge assembly H is mounted between the door 2 and the main body 1, the rotating members 60 and 60' rotate forward and backward according to opening and closing of the door 2 and simultaneously perform a reciprocal rectilinear movement to the left and right. The fixing member 50 accommodates and fixedly supports one end of the rotating members 60 and 60' and also plays a role of transferring a rotational force caused according to opening and closing of the door 2, to the rotating members 60 and 60'.

Also, the elastic members 70 and 70' are provided in one side of the rotating members 60 and 60' and play a role of preventing the door 2 from being abruptly closed via the compression and restoring processes performed by the rotating members 60 and 60' which rotate forward and backward according to opening and closing of the door 2 and simultaneously perform a reciprocal rectilinear movement to the left and right direction.

Also, the fixed shaft 80 has a tension bolt shape, and penetrates and is inserted into the throughholes 53 and 63 in the fixing member 50 and the rotating members 60 and 60', to thereby support a mutual coupling between the rotating members 60 and 60' and the fixing member 50 and play a role of restricting movement of the elastic members 70 and 70'.

That is, at the state where the rotating members 60 and 60' and the elastic members 70 and 70' have been assembled in turn, the fixed shaft 80 penetrates and is inserted into the throughholes 53 and 63 commonly formed in the fixing member 50 and the rotating members 60 and 60' and then fitted with a nut 81 in the end thereof to be fixedly combined with the hinge assembly H.

Here, a washer 82 is provided between the elastic members 70 and 70', and provides an elastic restoring force and an elastic repulsive force during operation of the hinge assembly H. As a result, the fixed shaft 80 limits the whole length of the hinge assembly H.

Here, the passive rotators 51 and 51' in the fixing members 50 and the rotators 61 and 61' in the rotating members 60 and 60' are formed in opposition to each other so as to be engaged with each other.

Thus, only one engagement case of the rotating members 60 and 60' and the elastic members 70 and 70' will be described below.

That is, a more specific embodiment of the rotating member 60 and the fixing member 50 will be described below with reference to FIGS. 8 and 9.

Figure 8:
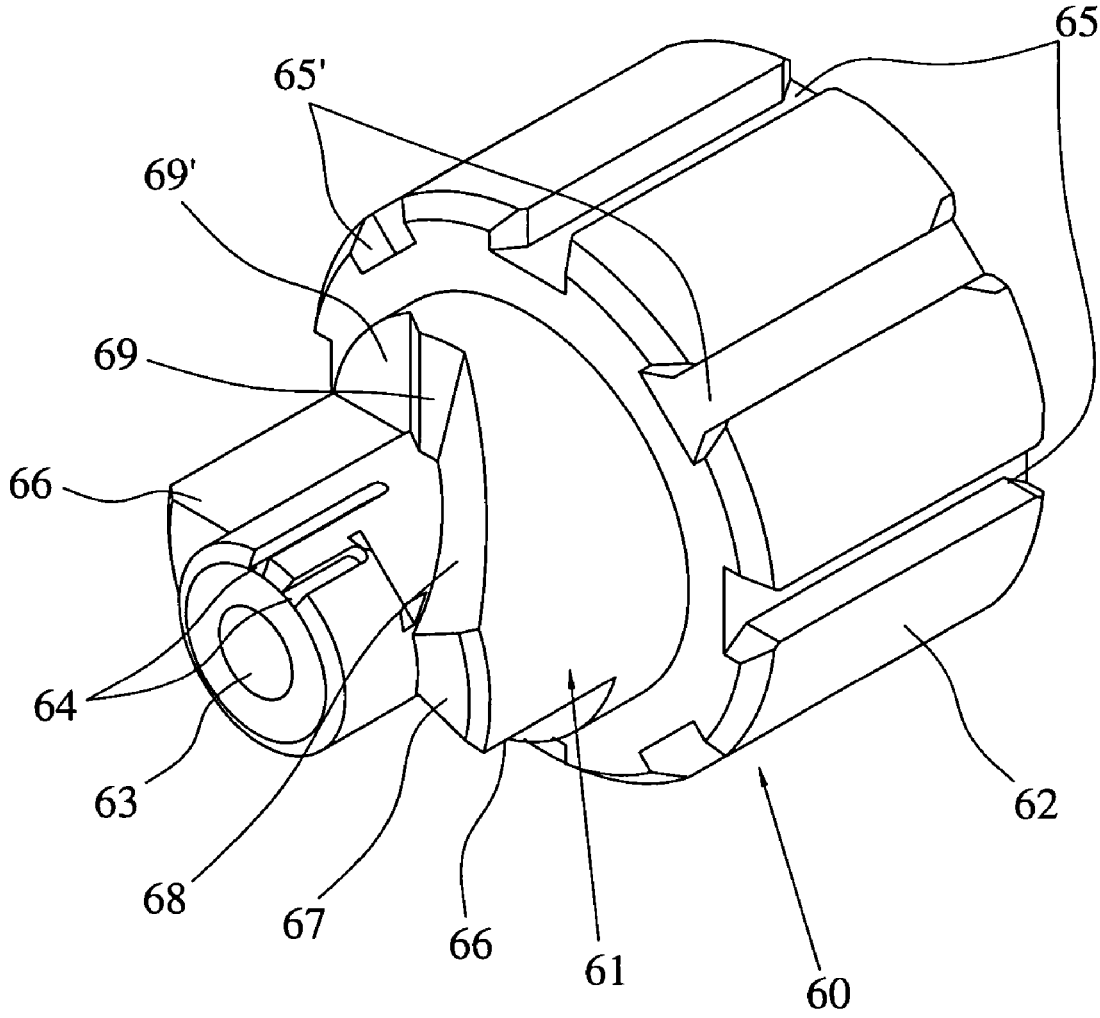
FIG. 8 is an enlarged perspective view showing a rotating member applied in the hinge assembly according to the present invention.

FIG. 8 is an enlarged perspective view showing a rotating member applied in the hinge assembly according to the present invention.

As shown in FIG. 8, the rotator 61 in the rotating member 60 includes a horizontally truncated surface 66 formed by horizontally truncating the outer circumferential surface of the throughhole 63 in the rotating member 60 in the axial direction thereof, and a sloped surface 68 having a counter-sloped surface 67 of a predetermined width in the radial direction from the leading end of the horizontally truncated surface 66 and then formed with a spiral slope in the axial direction.

Here, the horizontally truncated surface 66 and the sloped surface 68 are symmetrically formed by 180° around the throughhole 63, in plural numbers.

Also, steps 69 and 69' truncated differently from the slope line of the sloped surface 68 are formed at the end portion of the sloped surface 68, to thereby have a horizontal plane.

Figure 9:
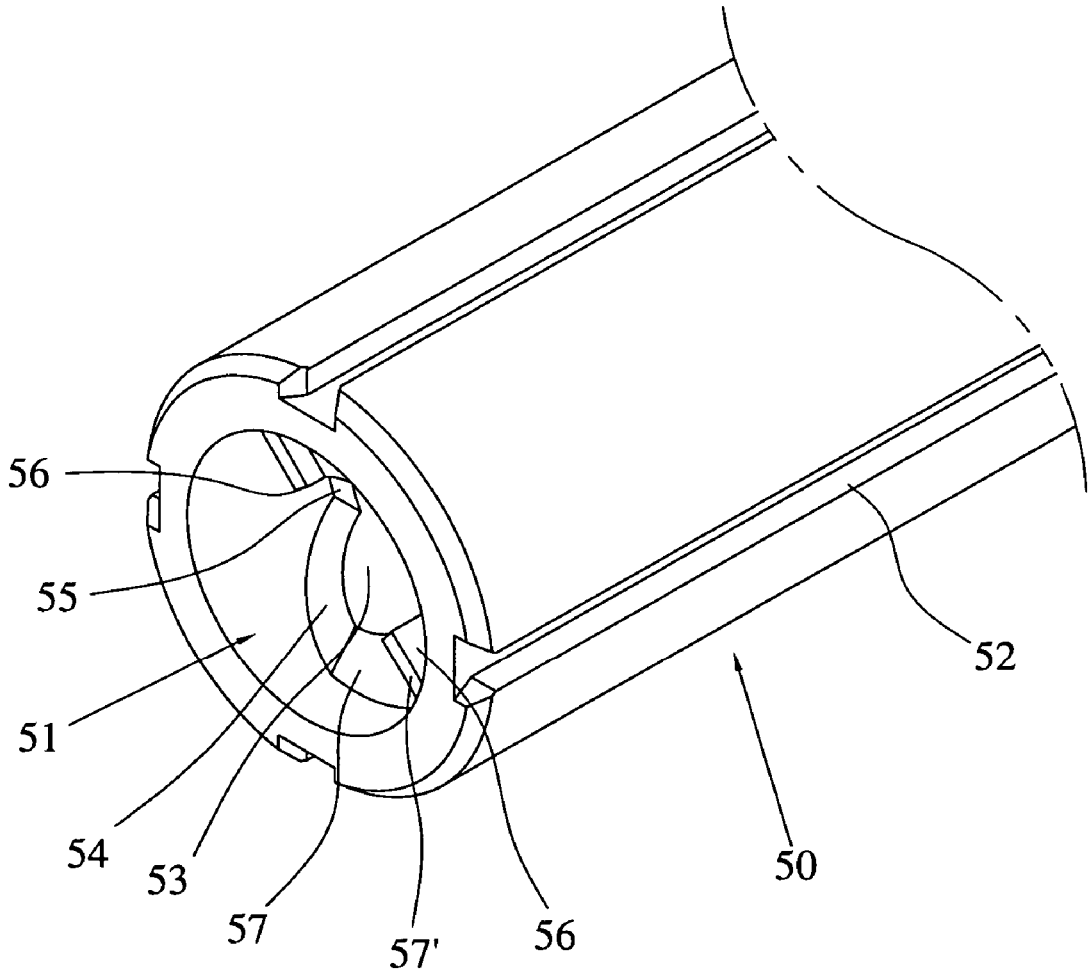
FIG. 9 is an enlarged perspective view showing part of a fixing member applied in the hinge assembly according to the present invention.

FIG. 9 is an enlarged perspective view showing part of a fixing member applied in the hinge assembly according to the present invention. As shown in FIG. 9, the passive rotator 51 in the fixing member 50 includes a spirally sloped surface 54 on the inner circumferential surface of the passive rotator 51 in the fixing member 50 in opposition to the sloped surface 68 in the rotator 61 in a surface-to-surface contacting manner, so that the rotating member 60 is completely inserted into and closely contacts the fixing member 50 and the former is engaged with the latter to operate interlockingly in correspondence to the structure of the rotator 61, and a horizontally truncated surface 56 formed by horizontally truncating one end of the sloped surface 54 in the axial direction.

Also, the sloped surface 54 and the horizontally truncated surface 56 are formed symmetrically by 180° in plural numbers.

Also, a counter-sloped surface 55 is formed in the passive rotator 51 so as to contact the counter-slope surface 67 in the rotator 61 in a surface-to-surface contacting manner, and is provided with protruding sections 57 and 57' in correspondence to the steps 69 and 69' in the rotator 61 in a surface-to-surface contacting manner.

In particular, in the case of the protruding section 57' formed in the passive rotator 51, the horizontally truncated surface 56 is formed in one side thereof, and the leading end thereof is protrudingly formed in comparison with the sloped surface 54. Also, the protruding section 57' is formed to have a relatively small area in comparison with the steps 69' in the rotator 61.

As described above, the reason why the protruding section 57' is formed to have a relatively small area in comparison with the steps 69' in the rotator 61, is to give a structure that the rotating member 60 is engaged with the step 69' in the rotator 61 in a surface-to-surface contacting manner when the rotating member 60 is completely inserted into the fixing member 50 in a close contacting manner, and allow for a stopper function of making the rotating member 60 not rotating any more when the rotating member 60 rotates and comes out along the sloped surface 54 formed in the passive rotator 51 in the fixing member 50 in which case the rotating member 60 rotates by 90°.

Also, the reason why the sloped surfaces 68 and 54 in the rotator 61 and the passive rotator 51 are formed symmetrically by 180° in plural numbers, is to make the door 2 opened in the upper surface of the storage room 3 by about 90° and to strengthen durability of the hinge assembly H in the case of the plural number of the surfaces 68 and 54.

As described above, since the sloped surface 68 in the rotator 61 and the sloped surface 54 in the passive rotator 51 are combined with each other and mutually operate in a surface-to-surface contacting manner, the hinge assembly structure according to the present invention is very excellent in view of durability thereof.

In particular, the spirally sloped surfaces 68 and 54 are formed to have a structure of compressing the elastic member 70 in which the sloped surface 68 in the rotating member 60 is taken out from the sloped surface 54 in the fixing member and separated from the fixing member 50 during rotating counterclockwise, and of receiving an elastic restoring force from the elastic member 70 in which the sloped surface 68 in the rotating member 60 is inserted into the fixing member 50 along the sloped surface 54 in the fixing member 50 during rotating clockwise.

That is, when the hinge assembly H is assembled between the door 2 and the main body 1, the counterclockwise direction means that the door 2 is closed and the clockwise direction means that door 2 is opened.

Meanwhile, when the sloped surfaces 68 and 54 in the rotator 61 and the passive rotator 51 are formed, the spirally sloped surfaces 68 and 54 are not formed in the whole axial direction from the leading end of the horizontally truncated surfaces 66 and 56, but counter-sloped surfaces 67 and 55 of a predetermined width are firstly formed in a radial direction and then the spirally sloped surfaces 68 and 54 are formed in the axial direction, based on the following reasons.

That is, when the door 2 is opened and then closed at the state where the hinge assembly H has been installed between the door 2 and the main body 1, the sloped surface 68 in the rotating member 60 is taken out along the sloped surface 54 in the fixing member and separated from the fixing member 50 to then compress the elastic member 70. In this process, the elastic member 70 is compressed and thus an elastic repulsive force gets larger. As a result, the closing speed of the door 2 is reduced to some degrees in proportion with the inertia of the descending door 2.

As described above, if the closing speed of the door 2 is reduced at a predetermined speed, the descending door 2 is prevented from being abruptly closed by the inertia according to the weight of the door 2.

However, it is not preferable that the descending speed of the door 2 is continuously reduced until the door 2 is completely closed, because it takes longer time until the door 2 is completely closed to deteriorate a closing function or an isolation function of the door 2 from the external air.

That is, if the door 2 reaches a predetermined height (within 5 to 10 approximately from the upper surface of the storage room 3), the inertia of the door 2 becomes relatively sharply larger in comparison with the elastic repulsive force of the elastic member 70. As a result, it is more preferable that the door 2 is abruptly closed to thereby heighten a closing function of the door 2.

Thus, in order to enhance a closing function of the door 2, counter-sloped surfaces 67 and 55 having slope surfaces differing from the spirally sloped surfaces 68 and 54 are formed in the radial direction.

The rotating member 60 reaches the counter-sloped surfaces 67 and 55, during moving along the sloped surface 54 in the fixing member 50 to then be separated from the fixing member 50.

Here, the door 2 is positioned at a height of 5 to 10° approximately from the upper surface of the storage room 3, which is located at a height just before the door 2 is completely closed.

If the rotating member 60 moves and reaches the counter-sloped surfaces 67 and 55 between the rotating member 60 and the fixing member 50 as described above, the rotating member 60 is pushed slightly toward the inner direction of the fixing member 50 at an instant time due to the counter-sloped surfaces 67 and 55, and thus the compression of the elastic member 70 which has been being continuously compressed is instantaneously released. As a result, the elastic repulsive force of the elastic member 70 which has been continuously increasing is instantaneously reduced.

If the elastic repulsive force of the elastic member 70 instantaneously stops being decreased or increased as described above, the inertia of the descending door 2 is relatively sharply increased and becomes larger than the elastic repulsive force of the elastic member 70. As a result, the door 2 is abruptly closed and enhances the closing function of the door 2.

It is preferable that the counter-sloped surfaces 67 and 55 are designed to a height where the door 2 can move within 5° to 10° until the door 2 is completely closed, but it is preferable that the counter-sloped surfaces 67 and 55 are designed optimally considering the inertia of the descending door 2 according to the weight of the door 2.

Meanwhile, in the case that the rotator 61 in the rotating member 60 has a structure of the spirally sloped surface 68, it is preferable that an oil supply groove 64 temporarily storing and supplying oil which is a lubricant is formed on the throughhole 63 in the rotating member 60.

That is, the oil supply groove 64 temporarily stores lubricant oil and supplies oil for a contact surface between the sloped surface 68 in the rotator 61 and the surface 54 in the passive rotator 51 so that the rotator 61 and the passive rotator 51 are engaged with each other and smoothly operate without friction.

Also, couplers 65 and 52 formed on the outer circumferential surfaces in the rotating member 60 and the fixing member 50 are provided in order to fixedly couple the corresponding coupler for operation of the hinge assembly H at the state where the rotating member 60 and the fixing member 60 have been assembled with each other, and the couplers 65 and 52 are formed in a conventional fittable coupling structure.

Figure 10:
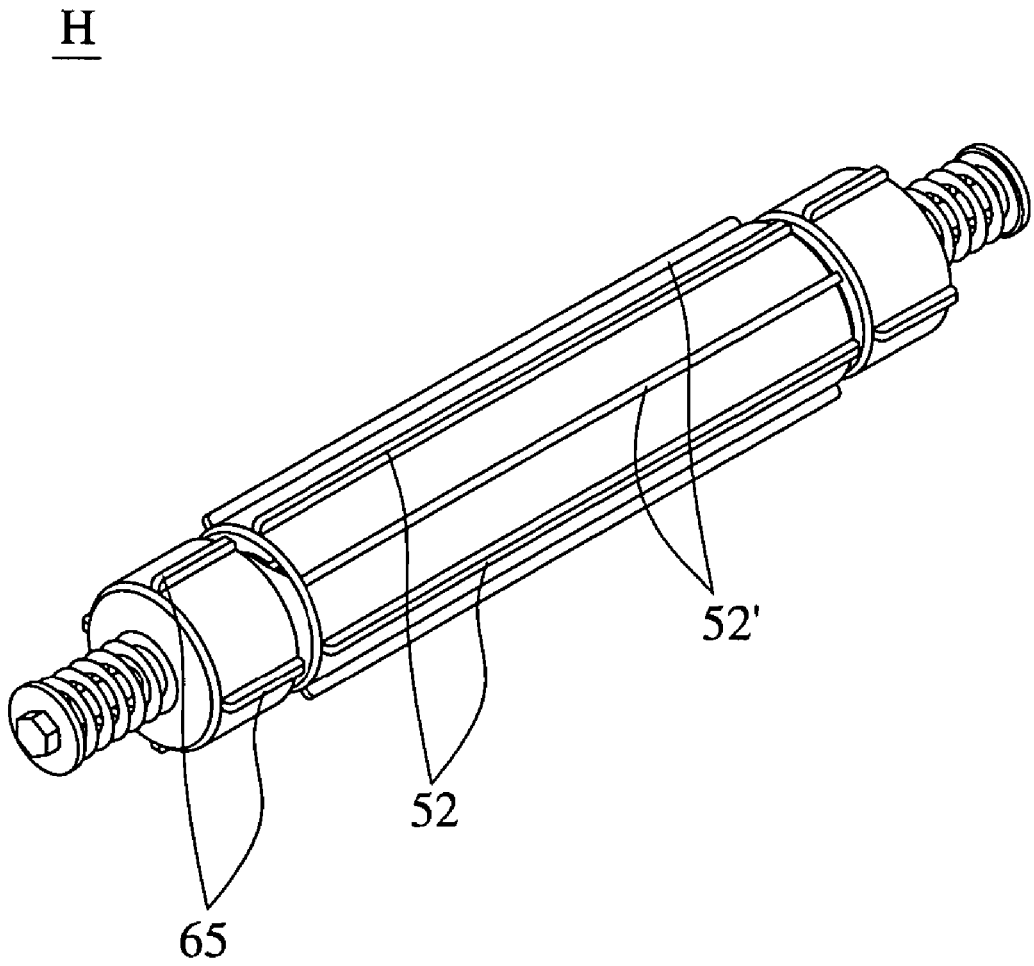
FIG. 10 is a perspective view showing a hinge assembly according to a second embodiment of the present invention, in which ribs are formed on the outer circumferential surface of the hinge assembly.
Figure 11:
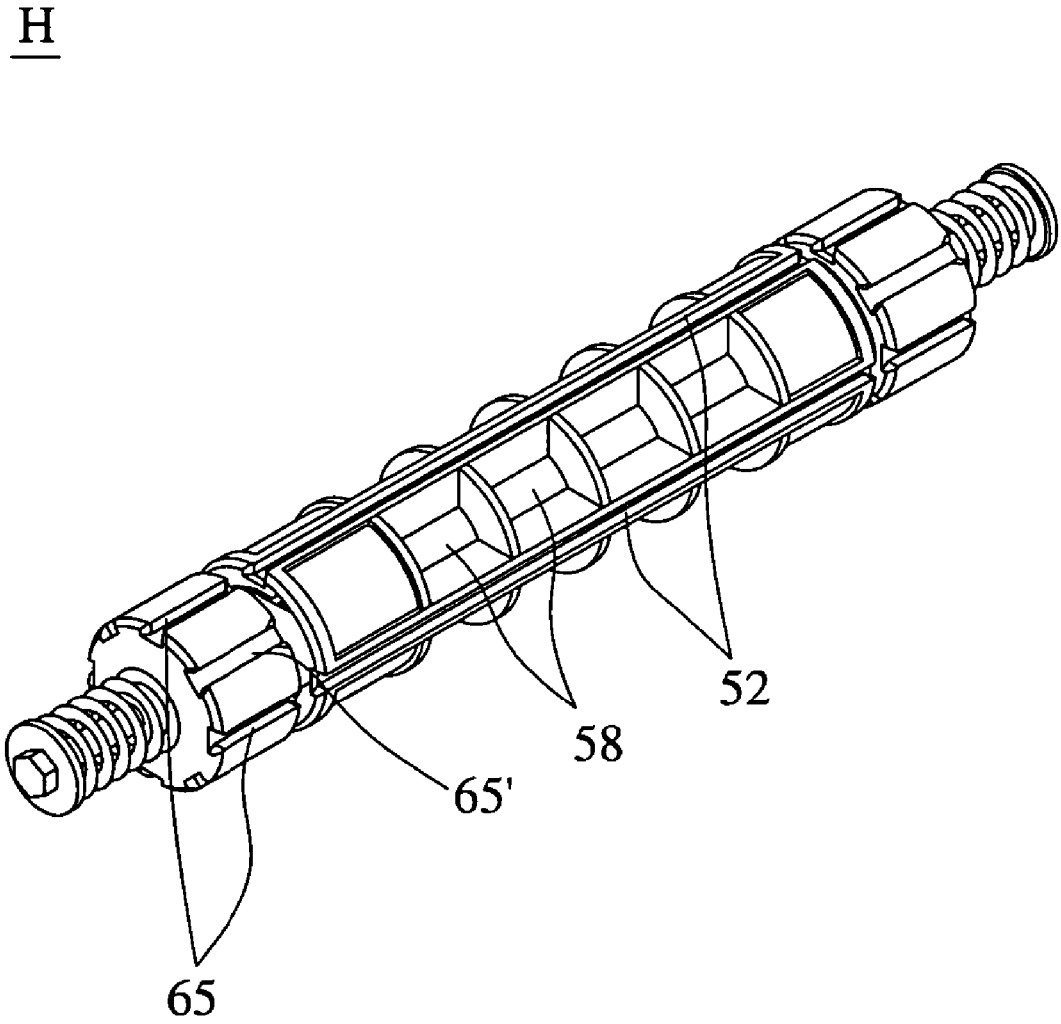
FIG. 11 is a perspective view showing a hinge assembly according to a third embodiment of the present invention, in which grooves are formed on the outer circumferential surface of the hinge assembly.

FIG. 10 is a perspective view showing a hinge assembly according to a second embodiment of the present invention, in which ribs are formed on the outer circumferential surface of the hinge assembly. FIG. 11 is a perspective view showing a hinge assembly according to a third embodiment of the present invention, in which grooves are formed on the outer circumferential surface of the hinge assembly. As shown in FIGS. 10 and 11, the couplers 65 and 52 are formed in the form of a groove formed lengthily inwards in the axial direction on the outer circumferential surface of the hinge assembly H or a rib lengthily protruded in the axial direction on the outer circumferential surface thereof, and disposed at a predetermined interval on the outer circumferential surface thereof.

When the rotating member 60 is assembled with the fixing member 50 in a closely contacting manner, the coupler 65 in the rotating member 60 and the coupler 52 in the fixing member 50 are disposed in a single straight line.

The reason why the couplers 65 and 52 are disposed in a single straight line is to make the hinge assembly H movably coupled along coupling guiders 91 and 101 to be described later when the hinge assembly H is installed and assembled.

In particular, stoppers 65' and 52' having the same shapes as those of the couplers 65 and 52 are provided in one of the outer circumferential surfaces in the rotating member 60 and the fixing member 50.

When the hinge assembly H is coupled with the hinge receptacle S, the stoppers 65' and 52' perform a stopper function which limits movement of the hinge assembly H so as to be safely loaded at an accurate installation position.

That is, in the case that the couplers 65 and 52 are formed in the form of a groove as shown in FIG. 6, a stopper 65' is formed in the form of a groove toward the rotating member 60.

In this case, since the stopper 65' is formed in the form of a groove at the state where the number of the couplers 65 formed on the outer circumferential surface of the rotating member 60 equals that of the couplers 52 formed on the outer circumferential surface of the fixing member 50, the number of the grooves formed on the outer circumferential surface of the rotating member 60 substantially seems to be larger than that of the grooves formed on the outer circumferential surface of the fixing member 50.

Also, in the case that the couplers 65 and 52 are formed in the form of a protruding rib as shown in FIG. 10, the stopper 52' is formed in the form of a rib on the fixing member 50.

Thus, in this case, the number of the ribs formed on the outer circumferential surface of the fixing member 50 substantially seems to be larger than that of the ribs formed on the outer circumferential surface of the rotating member 60.

In particular, as shown in FIG. 11, it is preferable that the fixing member 50 is fabricated in the form of a cylinder with a high intensity metal or a hard synthetic resin material. In order to save the weight and material of the fixing member 50, it is preferable that a number of grooves 58 are formed by performing a partial surface removal work over the whole outer circumferential surface of the rotating member 60 except for the peripheral portion of the coupler 52.

It is natural that there should be no problems in relation with the operation of the vhole hinge assembly H and the structural intensity necessary for the operation of the hinge assembly H, although a number of the grooves 58 have been formed through the partial surface removal work on the outer circumferential surface of the fixing member 50. The present invention is very effective and preferable in view of reduction of the production cost and the weight of the hinge assembly H.

Meanwhile, the hinge assembly H can be rotated only at the state where the hinge assembly H is fixedly supported to the corresponding coupling portion (for example, the hinge receptacle S provided between the door 2 and the main body 1).

As described above, the hinge assembly H has a structural feature as an elementary unit meeting a rotating condition. Only the hinge assembly H cannot operate by itself. The hinge assembly H is coupled with the relative receptacle such as a hinge receptacle S formed in the main body 1 and the door 2.

Hereinbelow, the structure of the hinge receptacle S in which the hinge assembly H is accommodated and coupled will be described with reference to FIGS. 12 and 13.

Figure 12:
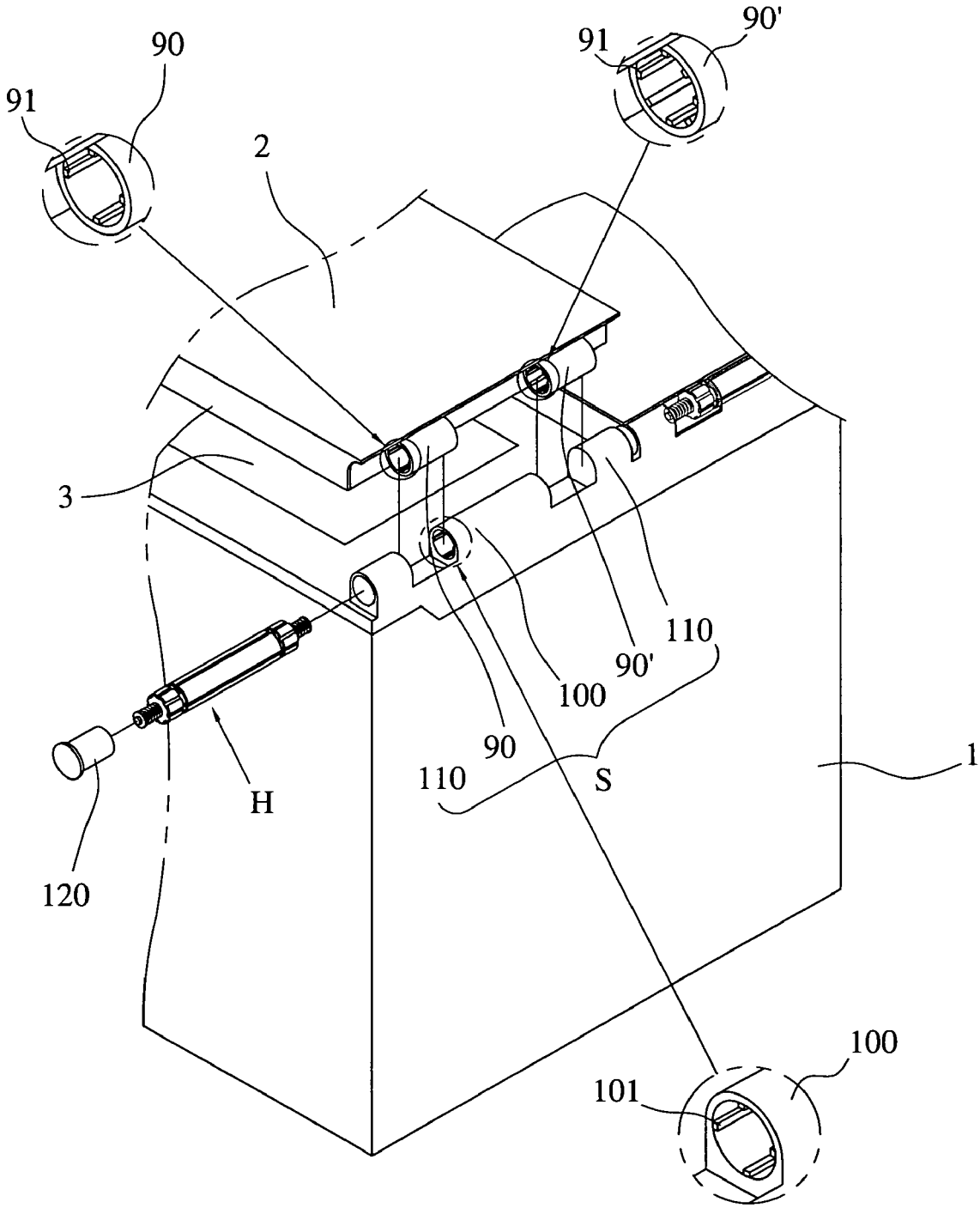
FIG. 12 is a perspective view showing an assembly process before a hinge assembly is installed between each door and a main body in a Kimchi storage facility, according to the first embodiment of the present invention.

FIG. 12 is a perspective view showing an assembly process before a hinge assembly is installed between each door and a main body in a Kimchi storage facility, according to the first embodiment of the present invention. FIG. 13 is a perspective view showing an assembly process before a hinge assembly is installed between each door and a main body in a Kimchi storage facility, according to the first embodiment of the present invention, in which a hinge receptacle differs from that of FIG. 12.

First, as described above, the hinge assembly H is mutually supported and coupled with the fixed shaft 80 at the state where a plurality of the rotating members 60 and elastic members 70 are assembled mutually symmetrically in both ends of the fixing member 50.

The hinge receptacle S according to the present invention which accommodates the hinge assemble H having the above-described structure is provided between the upper surface of the main body 1 and the rear surface of the door 2, as described above.

That is, the hinge receptacle S according to the present invention includes a cylindrical lower hinge receptacle 100 which is integrally formed in the upper surface of the main body 1, and accommodates either the fixing member 50 or one of a plurality of rotating members 60; a cylindrical upper hinge receptacle 90 and 90' which is integrally formed in the rear surface of the door 2, accommodated in the lower hinge receptacle 100 so that the upper hinge receptacle 90 and 90' is engaged with the lower hinge receptacle 100 to form a single accommodation space, and accommodates either the fixing member 50 or one of a plurality of the rotating members 60.

Here, whether or not the plurality of rotating members forming the hinge assembly H are safely loaded in the lower hinge receptacle 100 toward the main body 1, and whether or not the plurality of rotating members forming the hinge assembly H are safely loaded in the upper hinge receptacle 90 and 90' toward the door 2 can be selected by a designer during designing the hinge assembly H. Thus, the structure of the hinge receptacle S varies according to whether the plurality of the rotating members 60 are safely loaded toward the main body 1 or the door 2.

Here, each embodiment regarding which one of the upper hinge receptacle 90 and 90' and the lower hinge receptacle 100 are formed in plural numbers so that the rotating members can be safely accommodated, will be described later. First, the structural features of the upper hinge receptacle 90 and 90' and the lower hinge receptacle 100 will be described below.

First, coupling guiders 91 and 101 which are fitted and inserted in opposition to the couplers 52 and 65 in the fixing member 50 and the rotating member 60 and fixedly coupled with the couplers 52 and 65 are provided on the inner circumferential surfaces of the upper hinge receptacle 90 and 90' and the lower hinge receptacle 100 which formed in a structure of being engaged with each other cylindrically, respectively.

Here, the coupling guiders 91 and 101 are formed in the form of a groove when the couplers 52 and 65 are formed in the form of a rib so that the coupling guiders 91 and 101 are fitted and inserted in opposition to the couplers 52 and 65 in the fixing member 50 and the rotating member 60 and fixedly coupled with the couplers 52 and 65, and the coupling guiders 91 and 101 are formed in the form of a rib when he couplers 52 and 65 are formed in the form of a groove.

Here, each embodiment of several methods where the hinge assembly H is inserted into the hinge receptacle S having the coupling guiders 91 and 101 formed on the inner circumferential surface thereof will be described below.

First, FIG. 12 shows a case that the plurality of the rotating members 60 are safely loaded in the upper hinge receptacle 90 and 90' toward the door 2.

That is, in the case that the plurality of the rotating members 60 are safely loaded toward the upper hinge receptacle 90 and 90' as shown in FIG. 12, a plurality of upper hinge receptacles 90 and 90' are integrally formed on the rear surface of the door 2, with an interval where the lower hinge receptacle 100 closely contacts at the center of the plurality of upper hinge receptacles 90 and 90'.

Here, the lower hinge receptacle 100 includes a single receptacle which can accommodate the fixing member 50 on the upper surface of the main body 1 and a plurality of auxiliary supporters 110 which fixedly support the upper hinge receptacles 90 and 90' at the state where the lower hinge receptacle 100 is engaged with the upper hinge receptacle 90 and 90' and closely contact both ends of the upper hinge receptacle 90 and 90'.

Figure 13:
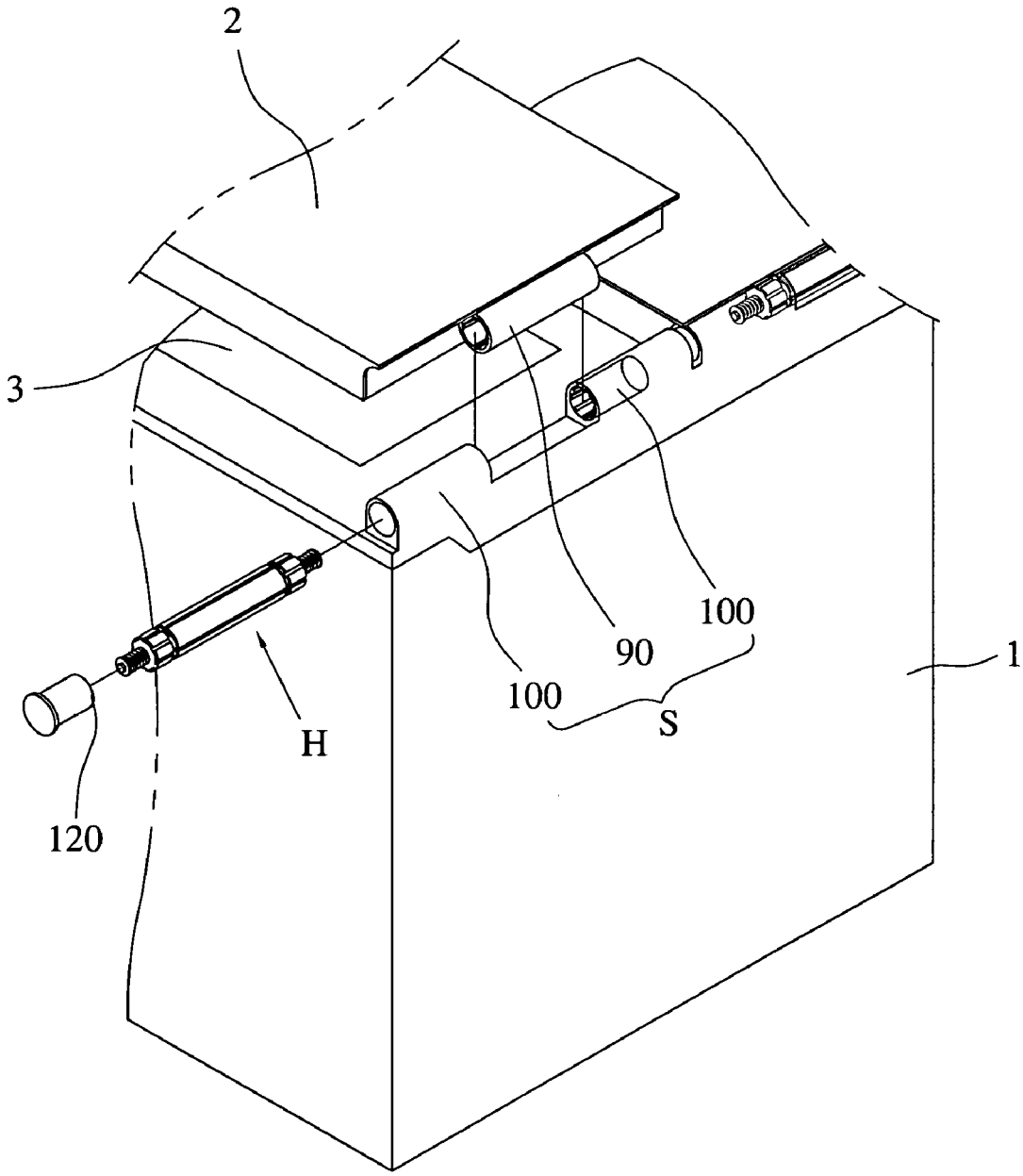
FIG. 13 is a perspective view showing an assembly process before a hinge assembly is installed between each door and a main body in a Kimchi storage facility, according to the first embodiment of the present invention, in which a hinge receptacle differs from that of FIG. 12.

FIG. 13 shows a case that the plurality of the rotating members 60 are safely loaded in the lower hinge receptacle 100 toward the main body 1.

That is, in the case that the plurality of the rotating members 60 are safely loaded toward the lower hinge receptacle 100 as shown in FIG. 13, a plurality of lower hinge receptacles 100 are integrally formed on the upper surface of the main body 1, with an interval where the upper hinge receptacle 90 closely contacts at the center of the plurality of lower hinge receptacles 100.

An upper hinge receptacle 90 is formed in the rear surface of the door 2 to thus accommodate the fixing member 50.

As described above, in the case that the rotating members 60 are accommodated toward the door 2, a plurality of the upper hinge receptacles 90 and 90' are formed in the rear surface of the door 2. In correspondence thereto, a lower hinge receptacle 100 for accommodating the fixing member 50 is integrally formed on the upper surface of the storage room 3 in the main body 1 (see FIG. 12).

Also, in the case that the rotating members 60 are accommodated toward the main body 1, a plurality of the lower hinge receptacles 100 are formed in the upper surface of the main body 1. In correspondence thereto, an upper hinge receptacle 90 for accommodating the fixing member 50 is integrally formed on the rear surface of the door 2 (see FIG. 13).

An assembly process where a hinge assembly according to the present invention is inserted into and assembled with a hinge receptacle and operation and function of the hinge assembly according to the present invention will be described below.

First, when a hinge assembly H is installed between the main body 1 and a door 2, the upper hinge receptacle 90 and 90' and the lower hinge receptacle 100 in the hinge receptacle S are engaged and assembled mutually in a single line.

As shown in FIG. 3, when the door 2 is opened and erected at 90° approximately, the hinge assembly H is fitted into and inserted into via one side of the hinge receptacle S.

The reason why the hinge assembly H is fitted into and assembled with the door 2 at the state where the door 2 is erected at 90° or so, can be found at an operational process of the hinge assembly H to be described later.

That is, in the case that each element of the hinge assembly H is assembled while maintaining a natural state, the rotating member 60 is not distant from the fixing member 50 at an initial state where the elastic member 70 has no elastic restoring force, and maintains a closely contacting state.

The above-described structure is possible when the door 2 is opened at maximum (about 90° or so) after the hinge assembly H is accommodated in the hinge receptacle S which will be described later.

Thus, at the state where the door 2 is opened and erected by 90° or so for the above-described reasons, the hinge assembly H is inserted into the hinge receptacle S.

Here, the couplers 65 and 52 and the stoppers 65' and 52' in the hinge assembly H are arranged to be engaged with the coupling guiders 91 and 101 in the hinge receptacle S, and then pushed into the hinge receptacle S via one side of the hinge receptacle S, that is, one side opening in the auxiliary supporter 110, so as to be inserted into an accurate position.

In particular, as shown in FIGS. 3 and 12, in the case that the coupler 65 and the stopper 65' in the hinge assembly H are formed in the form of a groove, and when the hinge assembly H is coupled and assembled with the hinge receptacle S, the fixing member 50 is not pushed any more into the upper hinge receptacle 90 and 90' located in an opposite direction to an insertion direction at the state where the fixing member 50 is accommodated in the lower hinge receptacle 100, to thereby limit movement of the hinge assembly H.

This is because the number of the couplers 65 formed on the outer circumferential surface of the rotating member 60' equals that of the coupling guiders 91 formed toward the upper hinge receptacle 90' in number due to the stopper 65', so that the hinge assembly H can be inserted into the hinge receptacle S, but the number of couplers 52 in the fixing member 50 is smaller than that of the coupling guiders 91 formed toward the upper hinge receptacle 90', so that the hinge assembly H cannot move forward any more.

Also, after the hinge assembly H is inserted into and fixedly coupled with the hinge receptacle S as described above, one side opening of the auxiliary supporter 110 in the hinge receptacle S into which the hinge assembly H is inserted is covered with a fixing cap 120. Accordingly, the hinge assembly structure according to the present invention is completely installed.

As described above, one reason why the opening of the auxiliary supporter 110 is covered with the fixing cap 120 after the hinge assembly H is inserted into the hinge receptacle S, is to couple the main body 1 and door 2 firmly.

Also, another reason is because the whole hinge assembly H may move in the opened direction during rotating according to opening and closing of the door 2, without having the fixing cap 120. Also, the other reason is because it is not preferable in an aesthetic point of view if the hinge assembly H is exposed externally via the opening of the auxiliary supporter 110.

That is, since the opening of the auxiliary supporter 110 is covered with the fixing cap 120, the hinge assembly H is prevented from moving in itself, and the opening is finished with a good appearance so that the hinge assembly H is not exposed externally, to thus enhance an aesthetic sense.

Figure 14:
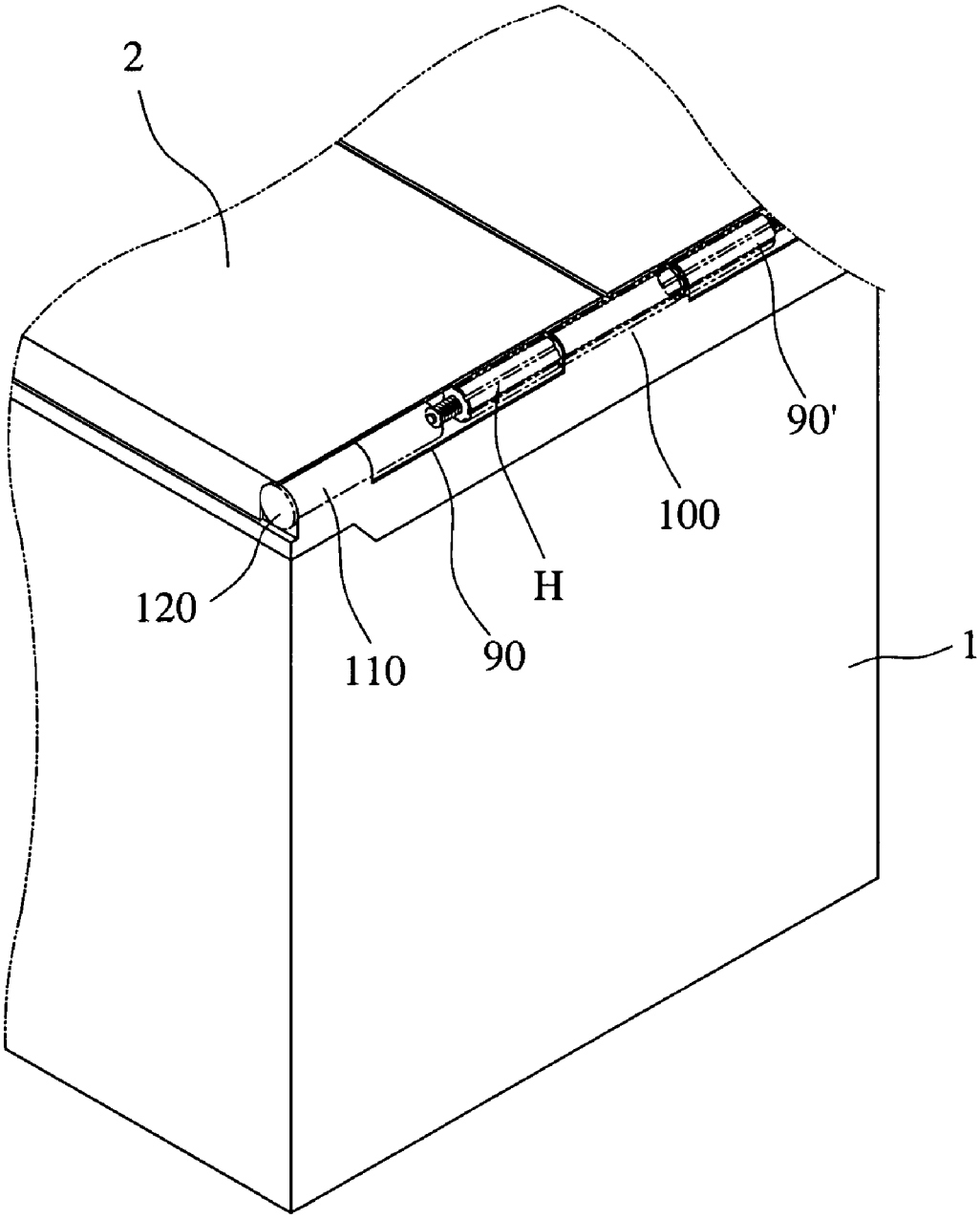
FIG. 14 is a perspective view showing a plurality of doors can be opened and closed with a single hinge assembly according to the first embodiment of the present invention.

Meanwhile, a plurality of doors 2 can be installed by using a hinge assembly H according to the first embodiment of the present invention, so that the doors 2 can be rotatably opened and closed FIG. 14 is a perspective view showing a plurality of doors can be opened and closed with a single hinge assembly according to the first embodiment of the present inventions.

That is, as shown in FIG. 14, the whole length of the hinge assembly H is fabricated and prepared as sufficient as the length to be installed over a plurality of doors 2.

In this state, when a plurality of doors 2 which open and dose each storage room 3 is installed, the lower hinge receptacle 100 accommodating the fixing member 50 is formed and located at the upper central portion of the plurality of storage rooms 3, that is, the upper central portion of the main body 1.

Simultaneously, each one of the upper hinge receptacle 90 and 90' accommodating the plurality of rotating members 60 is integrally formed in the rear surface of each of the doors 2 in correspondence to the lower hinge receptacle 100.

Also, at either edge of the main body is formed the auxiliary supporter 110 which closely contacts both sides of the upper hinge receptacles 90 and 90' together with the lower hinge receptacle 100, to thereby take hold of the left and right movement of the doors 2.

As described above, when a hinge assembly H is inserted into and installed in the hinge receptacle S formed over the plurality of storage rooms 3, the plurality of doors 2 can be rotatably opened and closed by using a single hinge assembly H.

Here, since the fixing cap 120 is fitted into the one side opening of the auxiliary supporter 10 and both the ends of the upper hinge receptacles 90 and 90' formed in the doors 2 are fixedly supported by the rotating member 60 and the fixing cap 120, the doors 2 are prevented from seceding from the rotating hinge assembly H.

Meanwhile, an operation of the hinge assembly according to opening and closing of the door in a Kimchi storage facility to which the present invention is applied will be described below in more detail.

Figure 15:
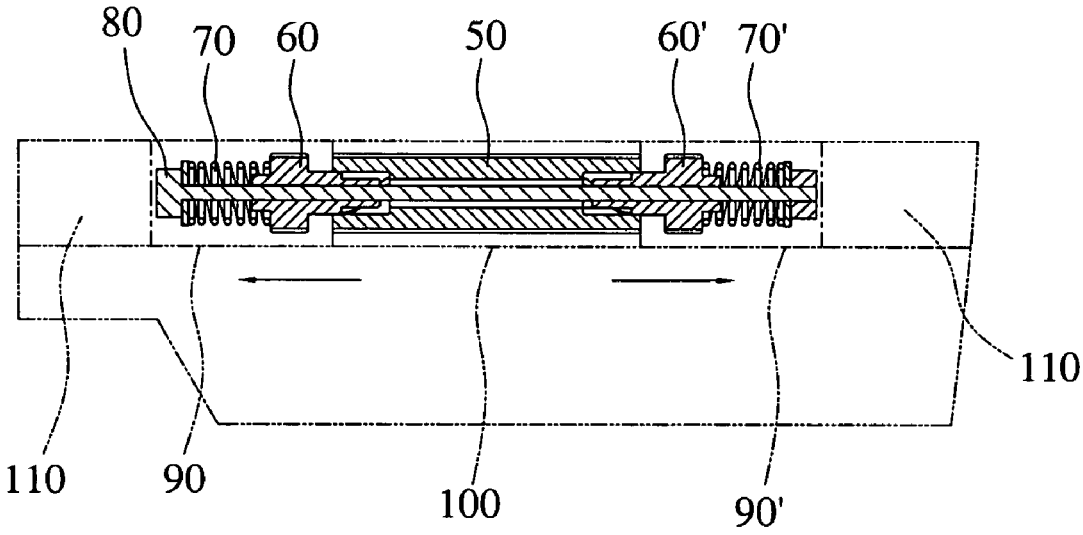
FIGS. 15 and 16 show an operational state of a hinge assembly according to the present invention, respectively.
Figure 16:
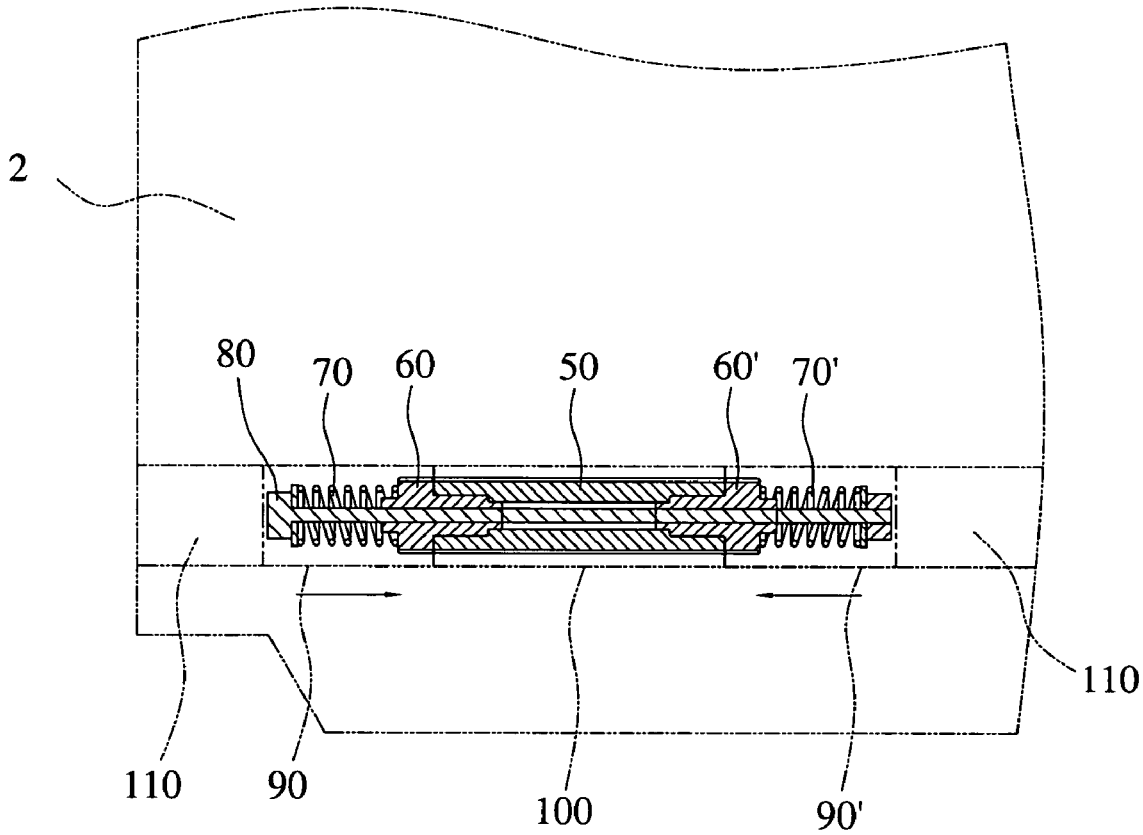

FIGS. 15 and 16 show an operational state of a hinge assembly H according to the present invention, respectively.

As shown in FIGS. 15 and 16, a plurality of rotating members 60 and 60' are accommodated in upper hinge receptacles 90 and 90', and a fixing member 50 is accommodated in a lower hinge receptacle.

In particular, FIG. 15 shows a process of compressing elastic members 70 and 70' since the plurality of rotating members 60 and 60' are pushed out from the fixing member 50 at the state where the door 2 is closed, and FIG. 16 shows a process of restoring elastic members 70 and 70' and maintaining a non-compressed initial state, since the plurality of rotating members 60 and 60' are inserted inwards from the fixing member 50 at the state where the door 2 is opened.

That is, when the door 2 is opened, the FIG. 15 state is changed into the FIG. 16 state.

Here, the operation of the hinge assembly H when the door 2 is opened, will be described below.

First, as described above, since the rotating members 60 and 60' are fitted and coupled with the upper hinge receptacles 90 and 90' in the door 2 via the coupling guider 91 formed in the upper hinge receptacles 90 and 90', the plurality of rotating members 60 and 60' rotate together with opening of the door 2 if the door 2 starts to be opened.

That is, when the door 2 starts to be opened, the rotating members 60 and 60' rotate clockwise according to an opened angle of the door 2, in view from the front-right side of the door 2.

At the same time when the rotating members 60 and 60' rotate clockwise, the fixing member 50 accommodated in the lower hinge receptacle 100 in the main body 1 maintains a fixed state as it is, and the rotating members 60 and 60' separated from the fixing member 50 are inserted inwards from the left and right sides of the fixing member 50 due to a direction of forming the spirally sloped surfaces 68 and 54, at the state where the rotators 61 and 61' in the rotating members 60 and 60' and the passive rotators 51 and 51' in the fixing member 50 are engaged with each other, in a surface-to-surface contacting manner.

That is, the rotating members 60 and 60' rotate integrally with the upper hinge receptacles 90 and 90' according to opening of the door 2, and perform a rectilinear movement along the coupling guider 91 formed in the axial direction on the upper hinge receptacles 90 and 90'.

Here, the elastic members 70 and 70' are elastically restored into an original state from a compressed state, and push the rotating members 60 and 60' inwards from the fixing member 50 and at both ends of the rotating members 60 and 60', to thereby further accelerate insertion of the rotating members 60 and 60'. As a result, the door 2 can be opened with a relatively small amount of labor force.

Thus, since the elastic restoring force of the elastic members 70 and 70' are applied during opening of the door 2, a user can open the door 2 easily with a small amount of labor force.

Meanwhile, the operation of the hinge assembly H when the door 2 is closed, will be described below.

When the door 2 is closed, the operation of the hinge assembly H is performed reversely from the opening process of the hinge assembly H.

That is, when the door 2 starts to be closed, the rotating members 60 and 60' rotate counterclockwise according to a closed angle of the door 2, in view from the front-right side of the door 2.

Accordingly, the fixing member 50 accommodated in the lower hinge receptacle 100 of the main body 1 maintains a fixed state as it is in the lower hinge receptacle 100, in the same way as the door 2 is opened.

Also, at the state where the fixing member 50 is fixed, the rotating members 60 and 60' come out from the inner direction of the fixing member 50 due to a direction of forming the spirally sloped surfaces 68 and 54, which are formed in the rotators 61 and 61' in the rotating members 60 and 60' and the passive rotators 51 and 51' in the fixing member 50, and perform a rectilinear movement along the coupling guider 91 formed in the axial direction on the upper hinge receptacles 90 and 90'.

Simultaneously, the elastic members 70 and 70' are pushed out and compressed bilaterally. In this case, the elastic repulsive force of the elastic members 70 and 70' become larger and larger and mitigate a closing speed of the door 2 according to a relationship between the weight of the descending door 2 and the elastic force.

In particular, when the door 2 is closed through the above-described operation, predetermined counter-sloped surfaces 67 and 55 are formed in radial direction at the edge position of the spirally sloped surfaces 68 and 54 in the rotators 61 and 61' and the passive rotators 51 and 51', as described above. Accordingly, if the rotating members 60 and 60' which are engaged while maintaining a surface-to-surface contacting state via the spirally sloped surfaces 68 and 54 reach the counter-sloped surfaces 67 and 55, that is, when the door 2 is positioned at a height of about 5° to 10° from the upper surface of the storage room 3, the rotating members 60 and 60' do not contact the spirally sloped surfaces 68 and 54 in a spiral surface-to-surface contacting manner in the axial direction, but contact the counter-sloped surfaces 67 and 55 instantaneously in a surface-to-surface contacting manner and in the axial direction. As a result, the continuously increasing elastic repulsive force of the elastic members 70 and 70' are instantaneously reduced, and thus the weight of the door 2 becomes large instantaneously and the door 2 is abruptly closed by the weight of the door 2. Thus, a sealing performance or isolation performance is enhanced.

As described above, when a door 2 which uses a hinge assembly H according to the present invention is opened, elastic members 70 and 70' return to an initial state, to thus generate an elastic restoring force, and assist the door 2 to be easily opened. Meanwhile, when a door 2 which uses a hinge assembly H according to the present invention is closed, the elastic members 70 and 70' are compressed, to thus generate an elastic repulsive force, and prevent the door 2 from being abruptly closed, and then make the door 2 quickly closed with only the weight of the door 2 at a predetermined height. Accordingly, the opening and closing of the door 2 is performed more stably.

As described above, the present invention provides a hinge assembly structure applied to a door in a Kimchi storage facility including rotating members which convert rotational movement into rectilinear movement according to opening and closing of a door, a fixing member accommodating and fixedly supporting the rotating members and operating in engagement with the rotating members, elastic members applying elastic restoring and repulsive forces to the rotating members, and a fixed shaft which fixedly coupling the rotating members, the fixing member, and the elastic members. Accordingly, the forward and backward movement and reciprocal rectilinear movement of the rotating members can be adjusted by the elasticity of the elastic members. As a result, a closing speed of a door using the hinge assembly can be mitigated, to thereby provide an effect of preventing an impact due to an abrupt closing of the door and easily opening the door with a small labor force.

Also, the present invention enables the hinge assembly to be simply inserted via one side of the hinge receptacle which is integrally provided in the door and the upper portion of the main body, when the hinge assembly is installed and assembled between the door and the main body. As a result, the hinge assembly structure is simple to thus provide an effect of a very excellent assembly performance.

As described above, the present invention is very useful and preferable having an effect of simply assembling the hinge assembly and enabling a stable opening and closing of a door.

What is claimed is:

1. A storage facility comprising:

a main body having at least one storage room and at least one opening providing access to said room;

at least one door for opening and closing the opening providing access to said storage room; and hinge means for connecting each door rotatably to said main body adjacent said opening;

each said hinge means including a first hinge receptacle means secured to said door and a second hinge receptacle means secured to said the main body adjacent said opening and engaged opposingly with said first hinge receptacle; and a hinge assembly including a fixing member having opposed ends defining passive rotators, each of said rotators having an inner cam surface; and a throughhole formed in said fixing member penetrating the passive rotators at the center thereof and defining a pivot axis for said door; said fixing member also having an exterior peripheral surface adapted to be received in one of said first and second hinge receptacles, the exterior peripheral surface of the fixing member and said one of said hinge receptacles in which it is received having first cooperating means preventing rotation of said fixing member in said one of said hinge receptacles during opening and closing of the door;

said hinge assembly also including a pair of rotating cam members respectively located adjacent said opposed ends of the fixing member and each having a rotator cam surface engaged opposingly with the inner cam surface of the adjacent passive rotator of the fixing member and a throughhole penetrating the central portion of the rotating cam members; said rotating cam members being received in the other of said first and second hinge receptacles; the exterior peripheral surface of said rotating cam members and said other of said hinge receptacles in which they are received having second cooperating means preventing rotation of the rotating cam members in that receptacle during opening and closing of the door; a shaft located in and extending through the throughholes of the rotating cam members and the fixing member; stop means at the ends of said shaft extending beyond said rotating cam members, and a pair of elastic members respectively mounted on the ends of said shaft between said rotating cam members and said stop means, whereby when said door is opened and closed said fixing member rotates on said shaft relative to said rotating cam members such that the cam surfaces of said fixing member and rotating cam members move relative to each other to urge the rotating cam members in linear directions along the shaft under the bias of said elastic members, said cam surfaces of said fixing member and said rotating cam members having i) first cooperating cam surfaces causing said rotating cam members to move axially along said shaft away from the fixing member as the door is moved from its open to its closed position to compress said elastic members and increase pressure on the rotating cam members to urge them against the fixing member cam surfaces with a continuously increasing force up to a predetermined and almost closed position before the door is fully closed and ii) second cooperating cam surfaces having a slope counter to the slope of the first cooperating cam surfaces to allow the rotating cam members to move axially along the shaft toward the fixing member to reduce pressure of said elastic members on said rotating cam members as the door moves from its predetermined almost closed position to its fully closed position.

2. A storage facility as defined in claim 1 wherein said main body has a top and said opening is formed in said top; and said first and second cooperating cam surfaces on said rotating cam members being angularly related in predetermined relationships so that when the door reaches said predetermined almost closed position it will move to its closed position solely under the gravitational effect on the weight of the door.

3. A storage facility as defined in claim 2, wherein said first and second cooperating means comprise at least one longitudinally extending groove formed on the outer surface of each of said fixing members and said rotating cam members and at least one longitudinally extending complementary rib formed in said first and second hinge receptacle means.

4. A storage facility as defined in claim 3, wherein said first and second cooperating means comprise a plurality of grooves formed respectively on the outer surfaces of said fixing member and rotating cam members and a plurality of ribs formed in said first and second hinge receptacle means.

5. A storage facility as defined in claim 4, wherein there are more grooves formed on the rotating cam members than on said fixing member, and more ribs formed on said second hinge receptacle means than on said first hinge receptacle means.

6. A storage facility as defined in claim 5, wherein an oil supply groove for temporarily storing and supplying lubricant oil is formed on the throughhole in the rotating cam members.

7. A storage facility as defined in claim 5, wherein said main body has a pair of adjacent storage rooms formed therein and a pair of doors for respectively opening and closing said openings, each said second hinge receptacle being integrally formed in a central portion of the main body adjacent each of said openings and said first hinge receptacle means being integrally formed on a rear surface of each said door, each said first hinge receptacle means comprising a pair of hinge receptacles integrally formed respectively on said doors, said fixing member being located in said second hinge receptacle means and said rotation cam members being respectively located in said pair of hinge receptacles and, auxiliary door supporter means is integrally formed adjacent each said pair of hinge receptacles for aiding in pivotally supporting the doors thereby to enable a plurality of doors to be installed by using a single hinge assembly.

8. A storage facility as defined in claim 1, wherein the rotator cam surfaces and the inner cam surfaces of the passive rotators each have a horizontally truncated surface which is formed in the axial direction so that they are rotatably engaged in a surface-to-surface contacting manner, and said first and second cooperating cam surfaces are spirally sloped surfaces formed with slopes in the axial direction from the leading end of the horizontally truncated surface, said horizontally truncated surfaces and said spirally sloped surfaces being located in opposition to each other in the open position of the door.

9. A storage facility as defined in claim 8, wherein the spirally sloped surfaces of said second cooperating cam sections are sloped in the axial direction commencing at the leading end of the horizontally truncated surface to a position at which they join their associated spiral sloped surfaces at the first cooperating cam surface which sloped away from the second cooperating cam sections in an opposite axial direction.

10. A storage facility as defined in claim 9, wherein a plurality of the horizontally truncated surfaces and the spirally sloped surfaces are formed in a 180° symmetrical structure in each of the rotating cam surfaces and said passive rotators, so that the horizontally truncated surface and the spirally sloped surfaces are located in opposition to each other around their respective central throughholes.

11. A storage facility as defined in claim 1, including fixing cap means for blocking one side of the hinge receptacle into which the hinge assembly is inserted.

* * * * *